US008953819B2

(12) United States Patent
Ko et al.

(10) Patent No.: US 8,953,819 B2
(45) Date of Patent: Feb. 10, 2015

(54) METHOD AND APPARATUS FOR FOCUSING SOUND USING ARRAY SPEAKER

(75) Inventors: Sang-chul Ko, Seoul (KR); Young-tae Kim, Seongnam-si (KR); Jung-ho Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1305 days.

(21) Appl. No.: 12/076,277

(22) Filed: Mar. 14, 2008

(65) Prior Publication Data

US 2009/0141915 A1 Jun. 4, 2009

(30) Foreign Application Priority Data

Dec. 4, 2007 (KR) ..... 10-2007-0124905

(51) Int. Cl.

| | |
|---|---|
| ***H04R 5/02*** | (2006.01) |
| ***H04R 5/00*** | (2006.01) |
| ***H04R 1/40*** | (2006.01) |
| ***H04R 3/00*** | (2006.01) |

(52) U.S. Cl.

CPC ..... *H04R 1/403* (2013.01); *H04R 3/005* (2013.01); *H04R 2430/23* (2013.01)

USPC ..... 381/98; 381/97; 381/104; 381/182; 381/89

(58) Field of Classification Search

CPC ..... H04R 1/403; H04R 2430/23; H04R 3/005

USPC ..... 381/97, 99, 89, 98, 104, 182, 77, 82

See application file for complete search history.

(56) References Cited

U.S. PATENT DOCUMENTS

| | | | | |
|---|---|---|---|---|
| 2005/0041530 | A1* | 2/2005 | Goudie et al. | 367/138 |
| 2006/0204022 | A1* | 9/2006 | Hooley et al. | 381/117 |
| 2007/0030977 | A1* | 2/2007 | Konagai | 381/17 |
| 2007/0081677 | A1* | 4/2007 | Nishikawa | 381/98 |
| 2007/0110268 | A1* | 5/2007 | Konagai et al. | 381/335 |

OTHER PUBLICATIONS

Korean Office Action issued Dec. 23, 2013 in corresponding Korean Application No. 10-2007-0124905.

* cited by examiner

*Primary Examiner* — Tom Thomas
*Assistant Examiner* — Benjamin Tzu-Hung Liu
(74) *Attorney, Agent, or Firm* — Staas & Halsey LLP

(57) ABSTRACT

Provided is a method and apparatus for focusing sound using an array speaker system. The method includes generating a plurality of delayed signals to be focused to a predetermined position from an input signal, filtering a low-frequency signal having a frequency that is lower than a reference frequency from the delayed signals, generating low-frequency focusing signals divided into 2 groups by adjusting a gain of the filtered low-frequency signal, and applying the low-frequency focusing signals divided into the 2 groups to speaker units of the array speaker system at both sides with respect to a center portion of the array speaker system and outputting the low-frequency focusing signals through the speaker units. In this way, the performance of sound focusing for the low-frequency signal can be improved and thus a listener located a predetermined distance from and in a predetermined direction relative to the array speaker system can clearly listen to the low-frequency focusing signals.

9 Claims, 8 Drawing Sheets

METHOD AND APPARATUS FOR FOCUSING SOUND USING ARRAY SPEAKER

CROSS-REFERENCE TO RELATED PATENT APPLICATION

This application claims the benefit of Korean Patent Application No. 10-2007-0124905, filed on Dec. 4, 2007, in the Korean Intellectual Property Office, the disclosure of which is incorporated herein in its entirety by reference.

BACKGROUND

1. Field

One or more embodiments of the present invention generally relates to a focusing method, medium and apparatus for focusing sound to a particular position, and more particularly, to a method and apparatus for focusing sound to a position located a predetermined distance from and in a predetermined direction relative to an array speaker system composed of a plurality of speakers by adjusting a sound signal using the array speaker system.

2. Description of the Related Art

An array speaker system is composed of a plurality of speakers that can adjust the direction of reproduced sound or radiate sound towards a particular area. The principle of sound transmission, generally called directivity, is to make a plurality of sound source signals overlap each other using phase differences between the sound source signals in order to increase signal strength along a specific direction, thereby transmitting the sound source signals in the specific direction. Thus, such directivity can be implemented by disposing a plurality of speakers in particular positions and adjusting the sound source signals of the array, which are output through the speakers.

As various portable digital devices have come into common use, the need for speakers capable of reproducing sound signals has increased. Along with this trend, users' expectation levels and demands with respect to a sound reproduction function implemented in a portable digital device also gradually increase. For example, users demand speakers with increasingly sophisticated technology that have evolved from conventional mono speakers to stereo speakers and further to multi-channel array speakers. In particular, as devices which allow a user to listen to sound while carrying, such as miniaturized digital devices including a digital multimedia broadcasting (DMB), a portable multimedia player (PMP), and a video-conference portable phone, have recently come into wide use, a focusing technique for focusing sound to a particular position desired by the user using an array speaker system is required for sound listening.

SUMMARY OF THE INVENTION

One or more embodiments of the present invention provides a method, medium and apparatus for focusing sound using an array speaker system whereby it is possible to overcome a limitation that a sound signal of a low-frequency domain is not properly focused due to a physically-fixed size of the array speaker system and to solve a problem that a user cannot clearly listen to the sound signal of the low-frequency domain when the user listens to the sound signal in a position located a predetermined distance from the array speaker system.

According to an aspect of the present invention, there is provided a method of focusing sound using an array speaker system. The method includes generating a plurality of delayed signals to be focused to a predetermined position from an input signal, filtering a low-frequency signal having a frequency that is lower than a reference frequency from the delayed signals, generating low-frequency focusing signals divided into 2 groups by adjusting a gain of the filtered low-frequency signal, and applying the low-frequency focusing signals divided into the 2 groups to speaker units of the array speaker system at both sides with respect to a center portion of the array speaker system and outputting the low-frequency focusing signals through the speaker units.

According to another aspect of the present invention, there is provided a computer-readable recording medium having recorded thereon a program for executing the method of focusing sound using an array speaker system.

According to another aspect of the present invention, there is provided an apparatus for focusing sound using an array speaker system. The apparatus includes a delay unit generating a plurality of delayed signals to be focused to a predetermined position from an input signal, a low-frequency filtering unit filtering a low-frequency signal having a frequency that is lower than a reference frequency from the delayed signals, a low-frequency focusing signal generation unit generating low-frequency focusing signals divided into 2 groups by adjusting a gain of the filtered low-frequency signal, and an output unit applying the low-frequency focusing signals divided into the 2 groups to speaker units of the array speaker system at both sides with respect to a center portion of the array speaker system and outputting the low-frequency focusing signals through the speaker units.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE INVENTION

Hereinafter, embodiments of the present invention will be described in detail with reference to the accompanying drawings. In the description of the embodiments of the present invention, a sound pressure expresses a force exerted by sound energy using the physical amount of pressure, and a sound source field conceptually expresses a region affected by the sound pressure around a sound source.

Figure 1:
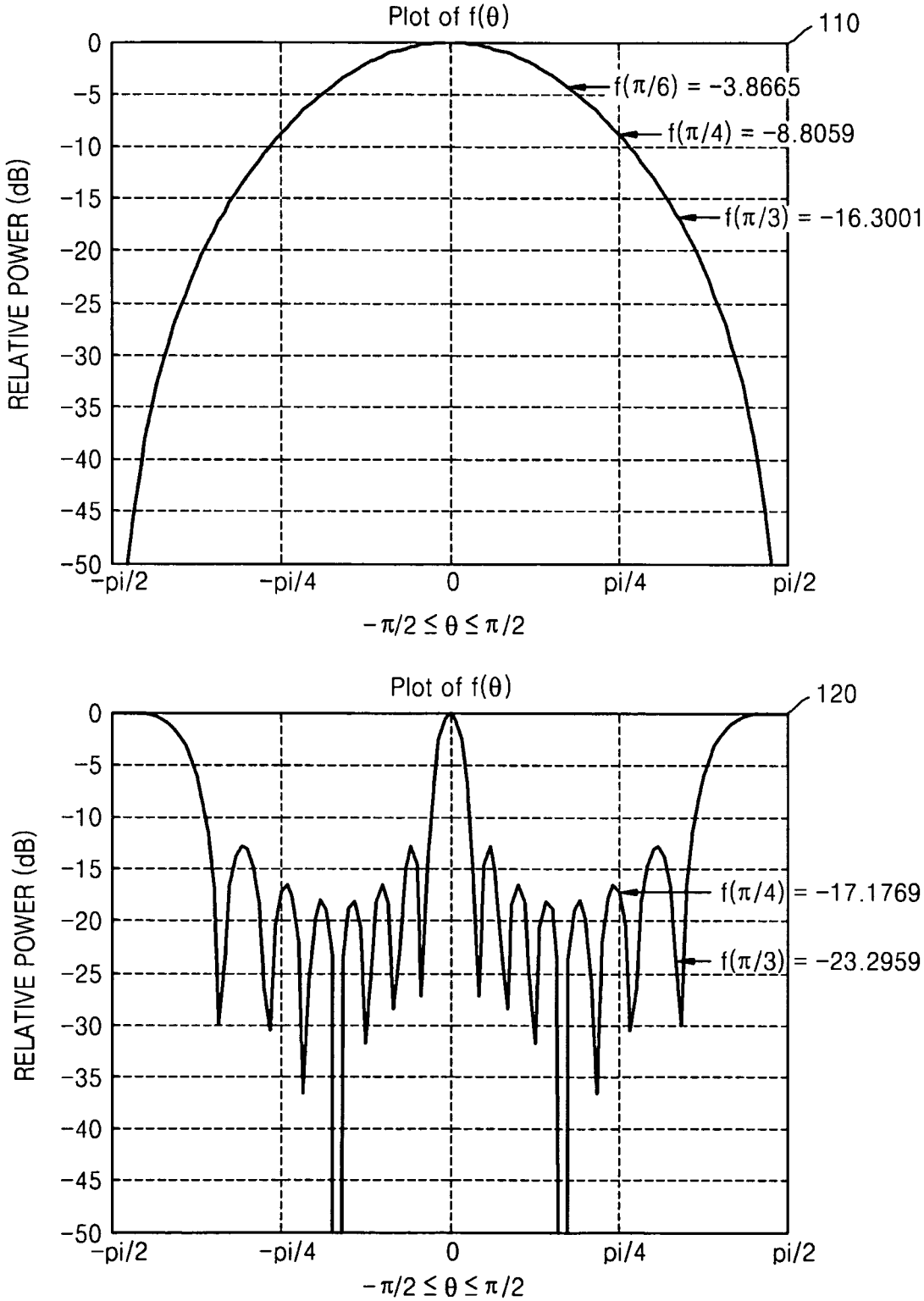
FIG. 1 illustrates radiation patterns of an array speaker system with respect to frequencies in order to explain a problem to be solved by the embodiments.

FIG. 1 illustrates radiation patterns of an array speaker system with respect to frequencies in order to explain a problem to be solved by the embodiments, in which the radiation patterns show low-frequency and high-frequency directivity characteristics. Here, a radiation pattern means a graph of measurements of electric field strengths of electromagnetic waves radiated in all directions from 0° to 360° from signal output devices such as a speaker and an antenna. The radiation pattern is obtained by receiving signals from all directions, between 0° and 360°, from a speaker, where the signals output from the speaker are received by and subject to measurement using a measurement device, which measures the received electric field strengths at each measurement angle, and the measurements are expressed in a waveform on a graph. By referring to FIG. 1, it is seen that electric field strength increases at coordinates further from a reference point of the graph (the center of the array speaker system), which means that there is directivity along a corresponding direction.

When an array speaker system is used, it is a general feature that the effect of sound adjustment changes according to frequency. Thus, in the case of a low frequency, if a wavelength is greater than the size of an array speaker system, it is difficult to focus sound to a particular position because of the beam width increase. In a radiation pattern 110 illustrated in FIG. 1, a sound signal radiated through the array speaker system forms a gentle curve without forming a radiation pattern having directivity. This problem occurs frequently in small-size audio devices because sound adjustment is not easy to perform in a small-size array.

On the other hand, in the case of a high frequency, the beam width decreases or unnecessary side robes occur. Side robes mean a radiation pattern that is non-uniformly generated within a beam pattern of the array speaker system. In a radiation pattern 120 illustrated in FIG. 1, a bar-shaped portion in the center of the radiation pattern 120 corresponds a directivity beam pattern for sound focusing and a portion having a plurality of small, thin peaks at both sides of the bar-shaped portion corresponds to a non-uniform beam pattern. Such a phenomenon may occur when an array size is greater than a wavelength.

At least one of the above-described problems may occur in a sound reproduction apparatus that outputs a sound signal having a broadband frequency instead of outputting a sound signal in a particular frequency band such as a high-frequency band or a low-frequency band. Thus, various embodiments of the present invention to be described below provide a method and apparatus for focusing sound whereby the performance of sound focusing can be improved in a low-frequency domain and sound focusing can be performed in a particular direction desired by a user without performance degradation even when a sound signal having a broadband frequency is output.

Figure 2A:
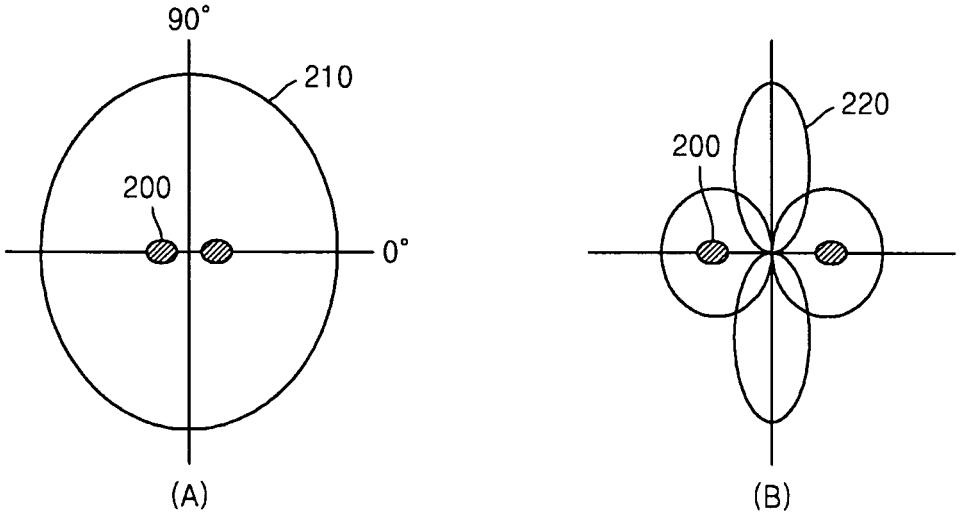
FIGS. 2A and 2B are diagrams for explaining the principle of changing of a radiation pattern with respect to distances between sound sources of an array speaker system from which sound source signals are radiated.
Figure 2B:
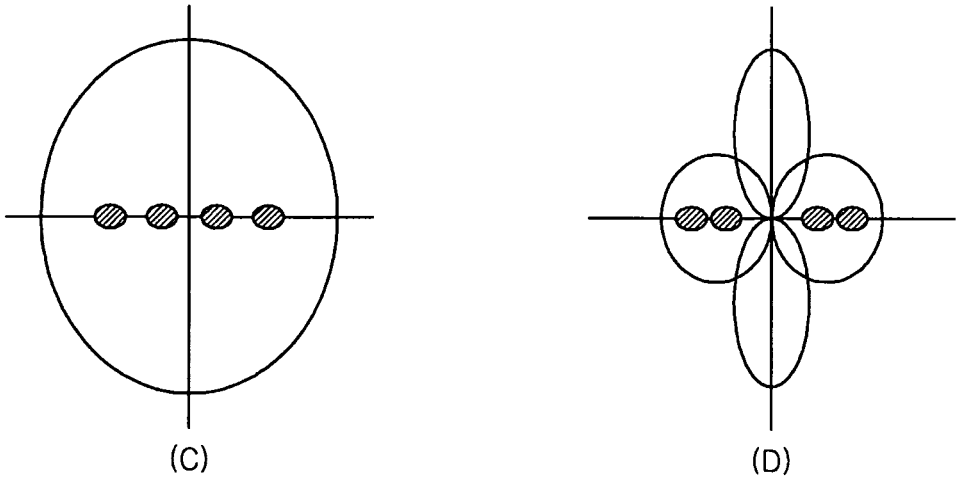

FIGS. 2A and 2B are diagrams for explaining the principle of changing of a radiation pattern with respect to distances between sound sources of an array speaker system from which sound source signals are radiated. While directivity is implemented using a single speaker unit (or a sound source) in FIG. 2A, directivity is implemented using a group composed of a plurality of speaker units in FIG. 2B. In FIGS. 2A and 2B, (a), (b), (c), and (d) each indicate the array speaker system on a coordinate system for convenience of explanation. In FIGS. 2A and 2B, it is assumed that the array speaker system is located parallel with a horizontal axis of the coordinate system and the center of the array speaker system is located in a point where the horizontal axis and a vertical axis meet or intersect. Small dashed circles indicate individual speaker units 200 and large circles indicate directivity patterns 210 and 220 formed by the speaker units 200.

While two speaker units 200 are located adjacent to each other in (a) of FIG. 2A, the speaker units 200 are located a predetermined distance from each other in (b) of FIG. 2A. In (a), the directivity pattern 210 radiated from the speaker units 200 is in a form that is similar to that of a directivity pattern radiated from a single speaker. In other words, (a) shows the characteristic of a monopole speaker in which sound is radiated from a single sound source. On the other hand, in (b), the speaker units 200 form separate specific sound source fields and the directivity patterns 220 are formed in a forward direction and a backward direction along the vertical axis in (B) of FIG. 2A with respect to a boundary between the sound source fields. In other words, focusing is performed in perpendicular to the array speaker system in the boundary between the two sound sources.

Unlike in FIG. 2A where only two individual speaker units 200 are used, in FIG. 2B, an array speaker system composed of a plurality of speaker units is used. In FIG. 2B, it is assumed that the array speaker system is composed of 4 individual speaker units. While the 4 speaker units are located adjacent to one another in (c) of FIG. 2B, the 4 speaker units form 2 groups each having a pair of speaker units in (d) of FIG. 2B. In (c), a directivity pattern radiated from the speaker units is similar to that radiated from a single monopole speaker. However, in (d), directivity patterns radiated from the speaker units are similar to those radiated from 2 speaker units located a particular distance from each other as in (b) of FIG. 2A.

Thus, even when a plurality of speakers are used, they are disposed at appropriate intervals in order to form 2 groups, thereby obtaining a similar effect to that obtained by changing the configuration of the speakers and the number of sound sources. In the following description, a group of speakers will be referred to as a sound source group. Such a principle can solve a problem that a user cannot focus sound in a desired direction due to a difficulty in sound adjustment for a low-frequency signal. Hereinafter, the application of the above-described focusing principle to a low-frequency signal will be described by way of example.

Figure 3:
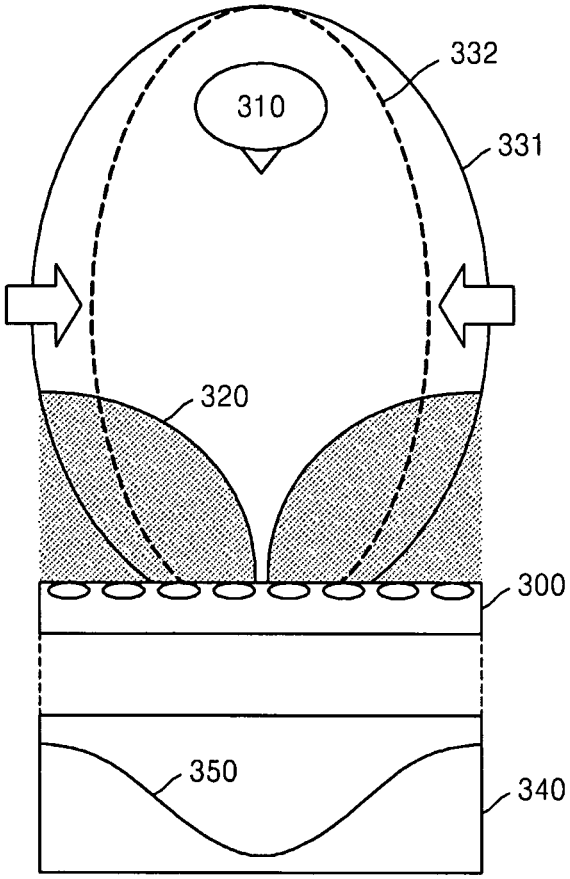
FIG. 3 is a diagram for explaining the implementation of directivity of a low-frequency signal using an array speaker system according to an embodiment of the present invention.

FIG. 3 is a diagram for explaining the implementation of directivity of a low-frequency signal using an array speaker system 300 according to an embodiment of the present invention. In FIG. 3, it is assumed that a listener 310 listens to a low-frequency signal radiated through the entire array speaker system 300. First, when low-frequency sound focusing is initially implemented using the array speaker system 300, it is not performed properly because the performance of sound adjustment degrades in a low-frequency domain as described above. In FIG. 3, a solid line 331 indicates a radiation pattern when sound focusing is implemented using the entire array speaker system 300.

By dividing speakers into 2 sound source groups as described with reference to FIGS. 2A and 2B, it is possible to obtain a similar effect to that obtained when 1 monopole speaker is located in an end portion at each side of the center of the array speaker system 300. In FIG. 3, 2 regions 320 formed in a forward direction with respect to the end portions of the array speaker system 300 indicate sound source fields formed by sound source groups. Thus, directivity is reinforced in a forward direction in a boundary between the sound source groups. In other words, the performance of sound focusing can be improved. In FIG. 3, a radiation pattern formed using 2 sound source groups is indicated by a dotted line 332. It can be seen from FIG. 3 that the radiation pattern changes from the solid line 331 to the dotted line 332 by using sound source groups, thereby improving the performance of sound focusing.

A graph 340 below the array speaker system 300 shows a gain of a sound source signal radiated through the array speaker system 300. In the graph 340, a horizontal axis corresponds to a position in the array speaker system 300 and a vertical axis corresponds to a gain of a sound source signal. In other words, a gain curve 350 in a U shape means that a gain of a sound source signal radiated through the array speaker system 300 is small in a center portion of the array speaker system 300 and the gain is large in an end portion of the array speaker system 300. Thus, various embodiments of the present invention to be described below will suggest a method of adjusting a gain in consideration of a position in an array speaker system as a means for dividing the array speaker system into 2 sound source groups when a low-frequency signal is applied to individual speaker units of the array speaker system. In addition, additional embodiments of the present invention will suggest a method of dividing an input signal according to frequency band for processing in order to focus a signal of a broadband frequency domain including a high-frequency signal as well as a low-frequency signal.

Figure 4:
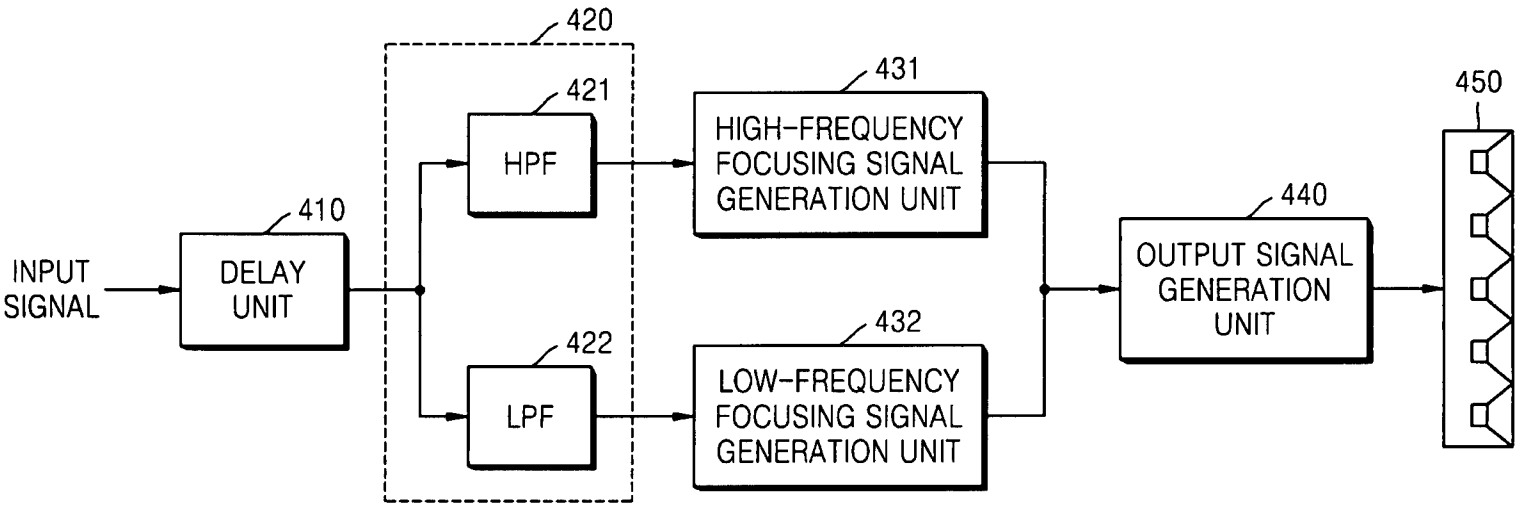
FIG. 4 is a block diagram of an apparatus for focusing sound using an array speaker system according to an embodiment of the present invention.

FIG. 4 is a block diagram of an apparatus for focusing sound using an array speaker system according to an embodiment of the present invention. Referring to FIG. 4, the apparatus includes a delay unit 410, a filtering unit 420 including a high-pass filter (HPF) 421 and a low-pass filter (LPF) 422, a high-frequency focusing signal generation unit 431, a low-frequency focusing signal generation unit 432, an output signal generation unit 440, and an output unit 450, i.e., an array speaker system 450, composed of a plurality of individual speaker units.

The delay unit 410 copies an input signal as many as the number of channels required for output and delays the copied signals by a predetermined amount of time in order to direct the copied signals to a particular focusing position. Here, the number of channels may be the number of individual speaker units of the array speaker system 450. Directivity adjustment for a sound signal output through the array speaker system 450 can be performed as follows:

$$\Delta = \left[\left(\frac{2\pi}{\lambda}\right)\cdot d\cdot \sin\theta\right], \tag{1}$$

where $\Delta$ indicates a delay value, $\lambda$ indicates a wavelength of a sound source signal to be output, d indicates a distance between individual speaker units of an array speaker system, and $\theta$ indicates an angle between the array speaker system and the radiation direction of a sound source signal. In other words, the delay unit 410 determines a delay value for each channel based on many variables like a physical characteristic of the array speaker system 450, such as the distance d, a feature of a sound source signal to be output, such as the wavelength $\lambda$, and an output direction or a focusing position.

The filtering unit 420 filters a high-frequency signal having a frequency that is higher than a reference frequency and a low-frequency signal having a frequency that is lower than the reference frequency from the delayed signals generated by the delay unit 410. The reference frequency means a frequency that serves as a criterion for filtering a high-frequency signal and a low-frequency signal from the input signals. A high frequency or a low frequency is a relative concept, and it is necessary to select a frequency from the entire broadband of the input signal for division into a high frequency and a low frequency.

As mentioned previously, in embodiments of the present invention, an input signal is divided according to frequency band because focusing of the input signal is not performed properly in a low-frequency domain. Consequently, the reference frequency has to be higher than or equal to a start point of a frequency at which focusing of the input signal is not performed properly. In the low-frequency domain, if a wavelength of an input signal is greater than the size of an array speaker system, it is difficult to focus sound to a particular position because of the beam width increase. For this reason, the reference frequency has to be set higher than or equal to a frequency at which the input signal is not focused to a particular position in consideration of the size of the array speaker system. In other words, the reference frequency may be set to a frequency at which the size of the array speaker system is greater than or equal to the wavelength of the input signal.

The reference frequency can be adjusted according to products or environments in which the embodiments of the present invention are actually implemented. Alternatively, the reference frequency may be experimentally calculated as a particular value in advance. Alternatively, the reference frequency may be set using a separate device in consideration of the size of an array speaker system or the number of individual speaker units, instead of being set to a fixed value in advance.

The high-frequency focusing signal generation unit 431 generates high-frequency focusing signals by adjusting a gain of the high-frequency signal filtered by the filtering unit 420. The high-frequency signal is a term used to express a concept compared to a low-frequency signal having a frequency that is lower than the reference frequency. As a result, the high-frequency signal may include both an middle band signal and a high band signal.

A high-frequency signal can be focused better than a low-frequency signal for which focusing is not properly performed because of low sound adjustment performance. To implement focusing of a high-frequency signal, various methods have been introduced. For example, various combinations of delay adjustment and gain adjustment can be used and various means for implementing those combinations, such as a finite impulse response (FIR) filter or an infinite impulse response (IIR) filter, can be used. These focusing methods can be easily designed by those of ordinary skill in the art, and among the focusing methods, gain adjustment will be described in detail in the following description.

According to the description made with reference to FIG. 1, side robes are likely to occur in a high-frequency signal in which the size of an array speaker system is greater than the wavelength of an input signal. Thus, in embodiments of the present invention for implementing focusing of a broadband signal, gain adjustment will be performed using a gain filter in order to remove side robes, simultaneously with focusing of the high-frequency signal.

In general, digital signal processing processes a target signal that is input to a system in units of a frame obtained by dividing the input signal using a window function in order to limit the input signal to a finite signal. Here, the frame means a signal processing unit obtained by dividing a sound source signal according to time. The window function is a kind of filter used to process one continuous sound source signal in units of a specific segment called a frame obtained by dividing the sound source signal according to time. Well-known window functions include a hamming window function, a hanning window function, and a cosine window function, as will be easily construed by those of ordinary skill in the art. These window functions are known as useful functions to remove side robes in a high-frequency domain.

The high-frequency focusing signal generation unit 431 adjusts a gain of the filtered high-frequency signal using the gain filter, i.e., the window function, so that the gain in a center portion of the array speaker system 450 is greater than the gain in an end portion of the array speaker system 450. In other words, gain adjustment is performed so that more portions of a sound source signal can be radiated from the center portion of the array speaker system 450. In this way, high-frequency focusing signals for focusing a high-frequency signal to a user-desired particular position can be generated, and at the same time, unnecessary side robes generated in the high-frequency domain can be removed.

The low-frequency focusing signal generation unit 432 adjusts a gain of the low-frequency signal filtered by the filtering unit 420 in order to generate low-frequency focusing signals divided into 2 groups. As previously described with reference to FIG. 3, the low-frequency focusing signal generation unit 432 divides the low-frequency signal into 2 groups in order to focus the low-frequency signal. For convenience of explanation, a group formed of sound source signals will be referred to as a signal group. The divided signal groups are applied to individual speaker units of the array speaker system 450. The individual speaker units are also grouped into 2 sound source groups corresponding to the signal groups. In other words, the individual speaker units are divided into the 2 sound source groups in consideration of a position of each of the individual speaker units on the array speaker system 450. The division is generally made into a left-half group and a right-half group with respect to the center portion of the array speaker system 450, but may also be made into groups, one of which includes more individual speaker units than the other, according to an environment where the current embodiment is implemented.

To divide the filtered low-frequency signal into signal groups, the low-frequency focusing signal generation unit 432 adjusts a gain of the filtered low-frequency signal so that the gain in the center portion of the array speaker system 450 is less than that in an end portion of the array speaker system 450. To this end, a U-shape gain filter is used as mentioned previously with reference to FIG. 3. This gain filter prevents a directivity characteristic of a sound source from being in a monopole form in a low-frequency signal, thereby allowing sound to be focused to a user-desired particular position.

The gain filter for generating the low-frequency focusing signals can be implemented using the following method. First, based on a fact that the shape of a gain filter for low-frequency focusing is opposite to that of a gain filter for high-frequency focusing, a reciprocal of the gain filter for high-frequency focusing, such as a hamming window function, a hanning window function, or a cosine window function, may be used as the gain filter for low-frequency focusing. A U-shape filter may also be generated by combining known window functions. Such a filter generation method can be easily construed by those of ordinary skill in the art by appropriately combining or reorganizing filter functions within a scope in which the sameness as the principle of directivity of a low-frequency gain filter is maintained.

The output signal generation unit 440 synthesizes the high-frequency focusing signals generated by the high-frequency focusing signal generation unit 431 and the low-frequency focusing signals generated by the low-frequency signal generation unit 432. If necessary, the synthesized signals may be amplified according to outputs of speaker units to which the synthesized signals are to be applied. The output signal generation unit 440 applies the focusing signals, which have been amplified as two sound source groups, to speaker units at both sides with respect to the center portion of the array speaker system 450. The applied signals are radiated to a particular position desired by a user through the array speaker system 450.

The apparatus for focusing sound using the array speaker system 450 according to an embodiment of the present invention has been described in detail. According to the current embodiment of the present invention, a low-frequency signal is divided according to a reference frequency and a gain of the low-frequency signal is adjusted, thereby generating low-frequency focusing signals divided into 2 signal groups and outputting the low-frequency focusing signals through the array speaker system 450 divided into 2 sound source groups. Consequently, the performance of sound focusing for the low-frequency signal can be improved and thus a listener located a predetermined distance from and in a predetermined direction relative to the array speaker system 450 can clearly listen to the low-frequency focusing signals. Moreover, by adjusting a gain of a high-frequency signal using a window filter and synthesizing generated low-frequency focusing signals and high-frequency focusing signals for output, it is possible to focus a broadband signal including a high-frequency signal as well as a low-frequency signal.

Figure 5:
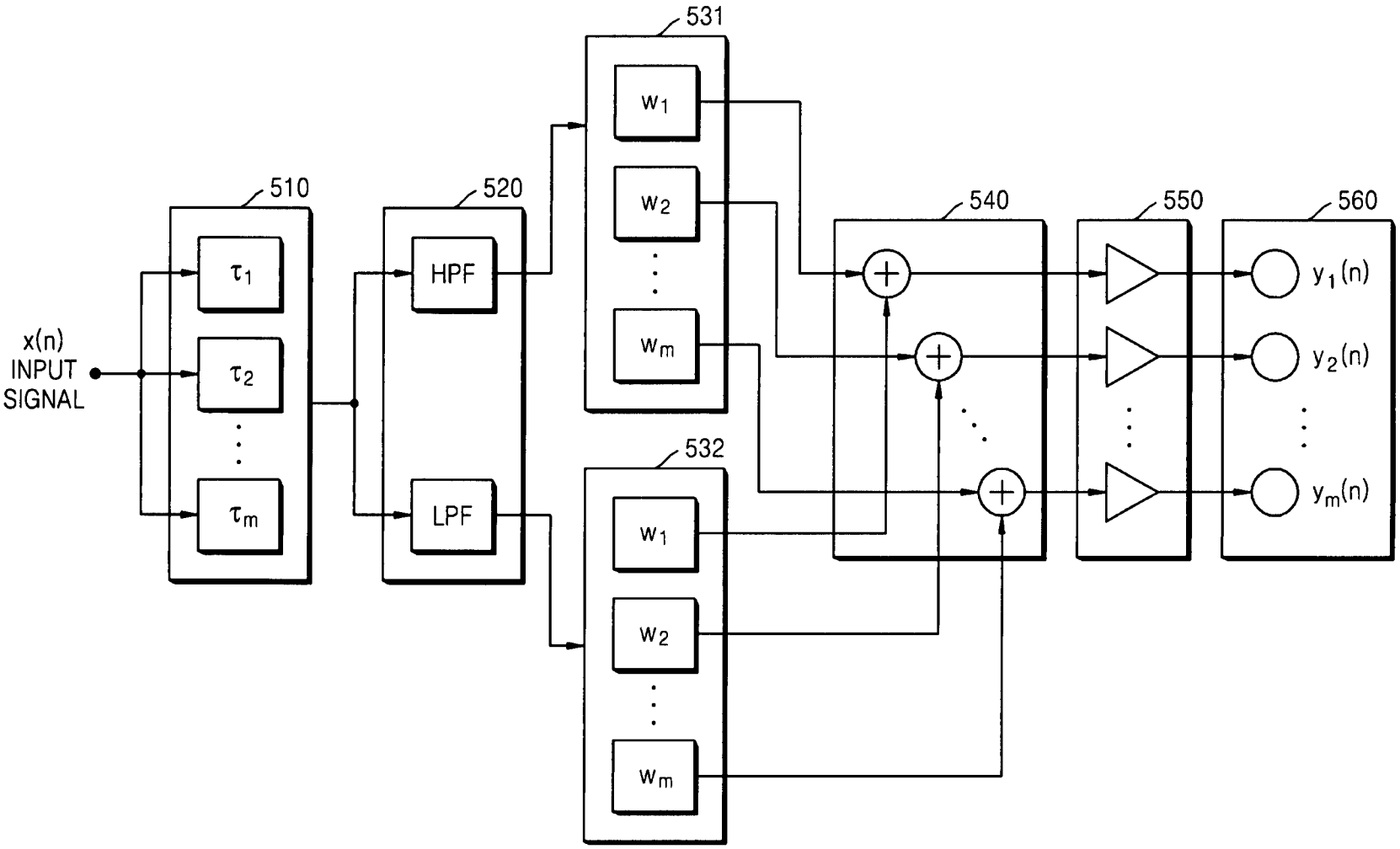
FIG. 5 is a detailed block diagram of an apparatus for focusing sound using an array speaker system according to an embodiment of the present invention.

FIG. 5 is a detailed block diagram of an apparatus for focusing sound using an array speaker system according to an embodiment of the present invention, in which a way to synthesize high-frequency focusing signals and low-frequency focusing signals for each channel of the array speaker system is shown by way of example. A delay unit 510, a filtering unit 520, a high-frequency focusing signal generation unit 531, a low-frequency focusing signal generation unit 532, and an output unit 560, i.e., an array speaker system 560, are the same as those described with reference to FIG. 4, and thus a description will be focused on a signal synthesis unit 540.

The high-frequency focusing signal generation unit 531 and the low-frequency focusing signal generation unit 532 adjusts a gain for each channel of the array speaker system 560. In FIG. 5, it is assumed that the number of channels of the array speaker system 560 is m. Thus, each of the high-frequency focusing signal generation unit 531 and the low-frequency focusing signal generation unit 532 generates m signals. The signal synthesis unit 540 synthesizes the m signals as pairs. The m synthesized output signals may be amplified by an amplification unit 550. Finally, the m output signals are applied to m individual speaker units of the array speaker system 560 in order to be output.

Figure 6:
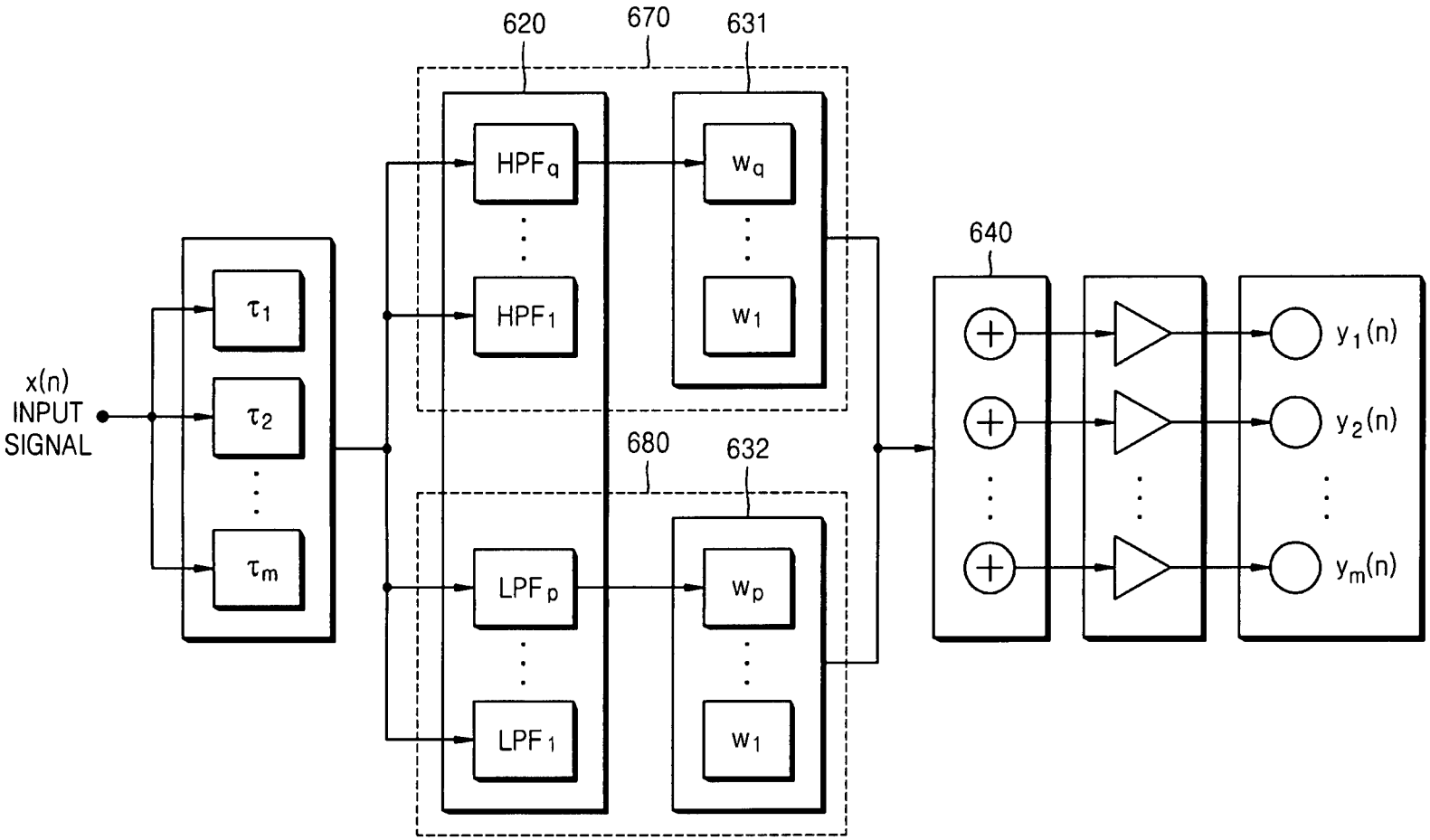
FIG. 6 is a block diagram of an apparatus for focusing sound by dividing a frequency band using an array speaker system according to another embodiment of the present invention.

FIG. 6 is a block diagram of an apparatus for focusing sound by dividing a frequency band using an array speaker system according to another embodiment of the present invention, in which signal filtering and gain adjustment according to frequency are different from those in FIG. 5.

A filtering unit 620 divides each of a high-frequency signal and a low-frequency signal into a plurality of small segments according to frequency band and provides the plurality of small segments to each of a high-frequency focusing signal generation unit 631 and a low-frequency focusing signal generation unit 632. In FIG. 6, the high-frequency signal is divided into q small segments and the low-frequency signal is divided into p small segments.

The high-frequency focusing signal generation unit 631 adjusts a gain for each of the divided segments so that a difference between the gain in a center portion of the array speaker system and the gain in an end portion of the array speaker system increases as a frequency of a signal included in the divided segment increases. In other words, a generated window filter is shaped so that the gain in the center portion increases and the gain in the end portion decreases as the frequency increases. On the other hand, the generated window filter may be shaped flat so that the difference between the gain in the center portion of the array speaker system and the gain in the end portion of the array speaker system decreases as the frequency approaches a reference frequency.

The low-frequency focusing signal generation unit 632 adjusts a gain for each of the divided segments so that the difference between the gain in the center portion of the array speaker system and the gain in the end portion of the array speaker system increases as the frequency of a signal included in the divided segment decreases. In other words, a generated window filter is shaped so that the gain in the center portion decreases and the gain in the end portion increases as the frequency decreases. On the other hand, the generated window filter may be shaped flat so that the difference between the gain in the center portion and the gain in the end portion decreases as the frequency approaches the reference frequency.

According to the foregoing embodiments of the present invention, input signals delayed according to frequency division performed by the filtering unit 620 are divided into a high-frequency signal group 670 and a low-frequency signal group 680 and a frequency band of each of the signal groups 670 and 680 is divided for gain adjustment, thereby improving the performance of sound focusing. More specifically, in the case of a high-frequency focusing signal, by means of gain adjustment using frequency division, it is possible to prevent the beam width of sound radiated through the array speaker system from increasing due to the frequency increase when the same window filter is applied to sound source signals, thereby maintaining a uniform beam width. In the case of a low-frequency focusing signal, the level of a monopole characteristic of a radiation pattern increases as the wavelength increases beyond the size of the array speaker system. In this case, a sound source division effect of a window filter can be improved by gain adjustment using frequency division.

Figure 7A:
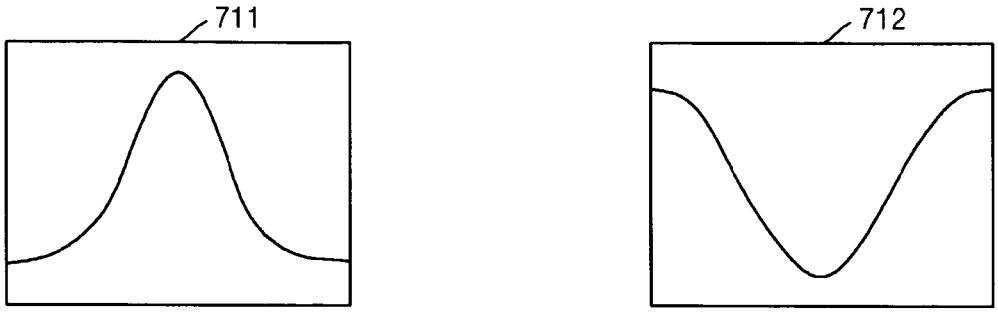
FIGS. 7A through 7C are diagrams for explaining gain adjustment according to frequency band using an array speaker system according to another embodiment of the present invention.
Figure 7B:
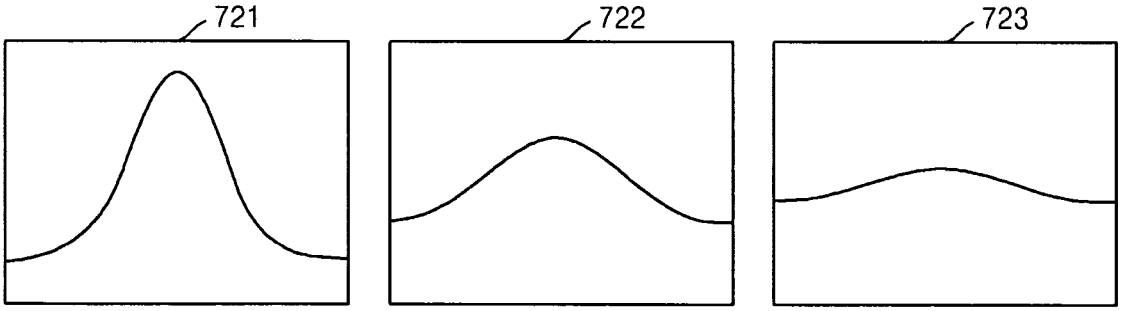
Figure 7C:
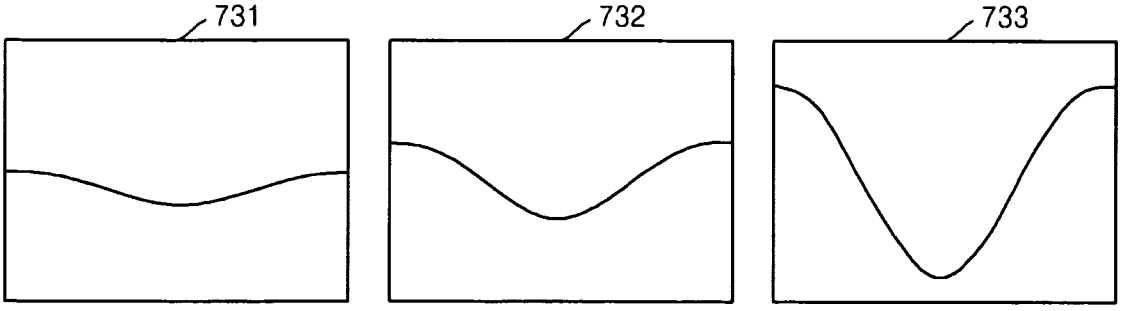

FIGS. 7A through 7C are diagrams for explaining gain adjustment according to frequency band using an array speaker system according to another embodiment of the present invention, in which a horizontal axis indicates a position in the array speaker system and a vertical axis indicates a gain. A window filter has already been described in detail and thus filter shapes will be briefly described by comparison with each other.

FIG. 7A illustrates window filters when an input signal is divided merely into a high frequency and a low frequency, in which a diagram 711 corresponds to a window filter for adjusting a gain of a high-frequency signal and a diagram 712 corresponds to a window filter for adjusting a gain of a low-frequency signal.

FIG. 7B illustrates window filters for adjusting a gain for each of 3 small segments obtained by dividing a high-frequency signal according to frequency. For the high-frequency signal, since a difference between a gain of the high-frequency signal in a center portion of an array speaker system and the gain in an end portion of the array speaker system increases as frequency increases as described previously, arrangement in descending order of frequency may be diagrams 721, 722, then 723. In particular, diagram 723 shows a flat gain graph as a window filter for a signal having a frequency that approximates a reference frequency.

FIG. 7C illustrates window filters for adjusting a gain for each of 3 small segments obtained by dividing a low-frequency signal according to frequency. For the low-frequency signal, since the difference between a gain of the low-frequency signal in the center portion of the array speaker system and the gain in the end portion of the array speaker system increases as frequency decreases as described previously, arrangement in ascending order of frequency may be diagrams 733, 732, then 731. In particular, like diagram 723 illustrated in FIG. 7B, diagram 731 shows a flat gain graph as a window filter for a signal having a frequency that approximates a reference frequency.

Figure 8:
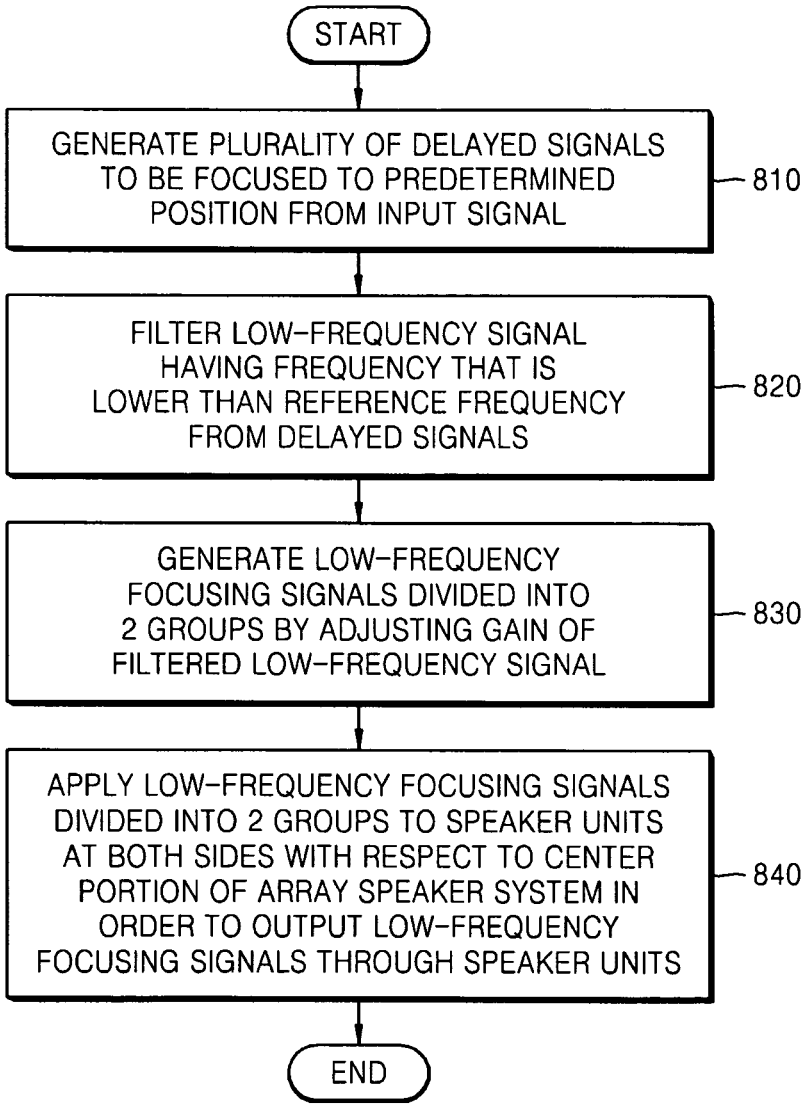
FIG. 8 is a flowchart illustrating a method of focusing sound using an array speaker according to still another embodiment of the present invention.

FIG. 8 is a flowchart illustrating a method of focusing sound using an array speaker according to still another embodiment of the present invention.

In operation 810, a plurality of delayed signals to be focused to a predetermined position are generated from an input signal.

In operation 820, a low-frequency signal having a frequency that is lower than a reference frequency is filtered from the delayed signals. The filtered low-frequency signal may also be divided into a plurality of small segments according to frequency band.

In operation 830, a gain of the filtered low-frequency signal is adjusted in order to generate low-frequency focusing signals divided into 2 groups. This operation is performed by adjusting the gain of the filtered low-frequency signal so that a gain of a center portion of the array speaker system is less than a gain of an end portion of the array speaker system. If the low-frequency signal has been divided into small segments according to frequency band in operation 820, gain adjustment may be performed for each divided segment so that the difference between the gain in the center portion and the gain in the end portion increases as the frequency of a signal included in the divided segment decreases.

In operation 840, the low-frequency focusing signals divided into 2 groups are applied to speaker units at both sides with respect to the center portion of the array speaker system in order to be output through the speaker units.

According to the current embodiment of the present invention, the performance of sound focusing for a low-frequency signal can be improved and thus a listener located a particular distance from and in a particular direction relative to an array speaker system can clearly recognize low-frequency focusing signals. Moreover, even when frequency decreases, a sound source division effect of a window filter can be improved by dividing a low-frequency signal, thereby maintaining the performance of sound focusing constant.

A computer-readable code on a computer-readable recording medium can be embodied. The computer-readable recording medium is any data storage device that can store data which can be thereafter read by a computer system.

Examples of computer-readable recording media include read-only memory (ROM), random-access memory (RAM), CD-ROMs, magnetic tapes, floppy disks, optical data storage devices, and carrier waves. The computer-readable recording medium can also be distributed over network of coupled computer systems so that the computer-readable code is stored and executed in a decentralized fashion. Also, functional programs, code, and code segments for implementing the embodiment of the present invention can be easily construed by programmers skilled in the art.

While the present invention has been particularly shown and described with reference to embodiments thereof, it will be understood by one of ordinary skill in the art that various changes in form and detail may be made therein without departing from the spirit and scope of the present invention as defined by the following claims. Accordingly, the disclosed embodiments should be considered in a descriptive sense not in a restrictive sense. The scope of the present invention will be defined by the appended claims, and differences within the scope should be construed to be included in the present invention.

What is claimed is:

1. A method of focusing sound using an array speaker, the method comprising:

generating a plurality of delayed signals to be focused to a predetermined position from an input signal;

filtering a low-frequency signal that is lower than a reference frequency out from the delayed signals into a filtered low-frequency signal;

generating low-frequency focusing signals divided into 2 groups by adjusting a gain of the filtered low-frequency signal;

dividing the low-frequency signal into a plurality of segments according to frequency band; and applying the low-frequency focusing signals divided into the 2 groups to speaker units of the array speaker at both sides with respect to a center portion of the array speaker and outputting the low-frequency focusing signals through the speaker units, wherein the generation of the low-frequency focusing signals comprises adjusting a gain of the filtered low-frequency signal so that the gain in the center portion of the array speaker is greater than zero and less than the gain in an end portion of the array speaker; and wherein the adjustment of the gain of the filtered low-frequency signal comprises adjusting the gain of the filtered low-frequency signal for each of the divided segments so that a difference between the gain in the center portion of the array speaker and the gain in the end portion of the array speaker increases as a frequency of a signal included in the divided segment decreases.

2. The method of claim 1, further comprising:

filtering a high-frequency signal that is higher than the reference frequency out from the delayed signals into a filtered high-frequency signal;

generating high-frequency focusing signals by adjusting a gain of the filtered high-frequency signal; and synthesizing the generated high-frequency focusing signals and the generated low-frequency focusing signals, wherein the outputting comprises outputting the synthesized signals.

3. The method of claim 2, wherein the generation of the high-frequency focusing signals comprises adjusting a gain of the filtered high-frequency signal so that the gain in the center portion of the array speaker is greater than the gain in an end portion of the array speaker.

4. The method of claim 1, further comprising setting a frequency at which a size of the array speaker is equal to or greater than a wavelength of the input signal to the reference frequency, wherein the filtering of the low-frequency signal comprises filtering the low-frequency signal based on the set reference frequency.

5. A computer-readable recording medium having recorded thereon a program for executing the method of claim 1.

6. An apparatus for focusing sound using an array speaker, the apparatus comprising:

a delay unit generating a plurality of delayed signals to be focused to a predetermined position from an input signal;

a low-frequency filtering unit filtering a low-frequency signal that is lower than a reference frequency out from the delayed signals into a filtered low-frequency signal;

a low-frequency focusing signal generation unit generating low-frequency focusing signals divided into 2 groups by adjusting a gain of the filtered low-frequency signal;

an output unit applying the low-frequency focusing signals divided into the 2 groups to speaker units of the array speaker at both sides with respect to a center portion of the array speaker and outputting the low-frequency focusing signals through the speaker units; and a frequency division unit dividing the low-frequency signal into a plurality of segments according to frequency band wherein the low-frequency focusing signal generation unit adjusts a gain of the filtered low-frequency signal so that a gain in the center portion of the array speaker is greater than zero and less than the gain in an end portion of the array speaker; and wherein the low-frequency focusing signal generation unit adjusts the gain of the filtered low-frequency signal for each of the divided segments so that a difference between the gain in the center portion of the array speaker and the gain in the end portion of the array speaker increases as a frequency of a signal included in the divided segment decreases.

7. The apparatus of claim 6, further comprising:

a high-frequency signal filtering unit filtering a high-frequency signal that is higher than the reference frequency out from the delayed signals into a filtered high-frequency signal;

a high-frequency focusing signal generation unit generating high-frequency focusing signals by adjusting a gain of the filtered high-frequency signal; and a signal synthesis unit synthesizing the generated high-frequency focusing signals and the generated low-frequency focusing signals, wherein the output unit outputs the synthesized signals.

8. The apparatus of claim 7, wherein the high-frequency focusing signal generation unit adjusts a gain of the filtered high-frequency signal so that the gain in the center portion of the array speaker is greater than the gain in an end portion of the array speaker.

9. The apparatus of claim 6, further comprising a reference frequency setting unit setting a frequency at which a size of the array speaker is equal to or greater than a wavelength of the input signal to the reference frequency, wherein the low-frequency signal filtering unit filters the low-frequency signal based on the set reference frequency.

* * * * *